United States Patent [19]

Horan

[11] Patent Number: 4,763,756

[45] Date of Patent: Aug. 16, 1988

[54] MULTI-PURPOSE WORK UNIT

[75] Inventor: Gerald P. Horan, Markham, Canada

[73] Assignee: Chart Industries Ltd., Pickering, Canada

[21] Appl. No.: 44,774

[22] Filed: May 1, 1987

[30] Foreign Application Priority Data

May 7, 1986 [CA] Canada ..... 508653

[51] Int. Cl.[4] ..... A47C 9/00; A47C 13/00

[52] U.S. Cl. ..... 182/20; 182/230

[58] Field of Search ..... 182/230, 20, 33, 35

[56] References Cited

U.S. PATENT DOCUMENTS

| | | | |
|---|---|---|---|
| 830,103 | 9/1906 | Rundell | 182/230 |
| 1,529,498 | 3/1925 | Novak | 182/230 |
| 2,052,973 | 9/1936 | Furtzaig | 182/230 |
| 2,069,476 | 2/1937 | Keil | 182/230 |

FOREIGN PATENT DOCUMENTS

| | | | |
|---|---|---|---|
| 628746 | 9/1949 | United Kingdom | 182/230 |

*Primary Examiner*—Reinaldo P. Machado

*Attorney, Agent, or Firm*—Ivor M. Hughes

[57] ABSTRACT

A multi-purpose work unit comprising a platform having; a top side, and bottom side, carrying on the platform top an anti-slip surface, and a padding on the bottom side; a plurality of support members of alternative cross-section having a top section extending from the bottom side of the platform at its extremities parallel to the platform and abutting the interior surfaces of the platform and fastened thereto, said support members continuing from the platform extremities in a downward angle away from the platform and arcing at the extremities of the support remote the platform defining a support member bottom, continuing therefrom in complimentary circumscription returning to its origin at the underside of the platform; wherein a number of relationships exist amongst the dimensions of the work unit described.

22 Claims, 3 Drawing Sheets

MULTI-PURPOSE WORK UNIT

FIELD OF INVENTION

This invention relates to a multi-functional work unit used for standing, kneeling, sitting, and reaching activities normally conducted about the home, garden, workshop or workplace.

BACKGROUND OF THE INVENTION

Work units provided in the work place are available to assist the worker reaching hard to access obscure places as embodied in a ladder or a stepping stool. Further, industrial-type knee pads may be acquired for those workers who have to spend much of their work day stooped over, or in a kneeling position. However, to the best of Applicant's knowledge a device is not currently available which combines into one device described herein as a work unit, both a kneeling device defined to assist an older or less agile worker or individual from a standing position to a kneeling position, and a stepping stool which is very difficult to upset in any direction.

It is therefore an object of this invention to overcome the problem of an older or less agile individual kneeling down from a standing or alternate position unassisted subjected to the danger of a fall, and resulting injury.

It is a further object of this invention to provide a support means for an individual to assume a kneeling position.

It is a further object of this invention to provide a support and cushioning means for an individual's shins or knees while the individual is in a kneeling position.

It is a further object of this invention to provide an anti-tipping work unit constructed in a rigid fashion of dimensions suitable to offer the user extreme security in standing thereupon or when reaching out for implements or over obstacles, thereby precluding tipping.

It is a further object of this invention to provide an anti-tipping work unit constructed of suitable dimensions in one embodiment which will allow a less than average height individual secure support while working at standard ceiling height.

It is a further object of this invention to provide a work unit of particular usefulness to the geriatric community.

Further and other objects of this invention will become apparent to a man skilled in the art when considering the following summary of the invention and the more detailed embodiments of the invention illustrated herein.

SUMMARY OF THE INVENTION

To these ends according to one aspect of the invention a multi-purpose structurally solid work unit is provided comprising a platform containing upon its top an anti-slip surface (in a preferred embodiment the anti-slip surface comprising alternate grooves and ridges for providing a positive traction means for the footing of anyone standing and/or reaching therefrom); and padding on the underside thereof (in one embodiment the padding being secured in a cavity created by depending peripheral rim portions extending from the platform carrying the anti-slip surface and inwardly-directed lips secured to the ends of the rim remote the platform directed towards the centre of the platform to provide a cavity therein for receiving the padding), the padding preferably comprising an oversized cushioning means for extending within said cavity abutting all interior surfaces contained therein, and extending below the platform; at least two support members, one from each opposed side extending from the underside of the platform proximate its sides, (in a preferred embodiment each of said support members being manufactured from one continuous member having a portion fastened in parallel fashion to the underside of the platform near the centre line of the top abutting the interior surface of said rim and fastened to said rim, and said support member continuing therefrom to the extremities of the platform and then continuing at an angle DCA downwardly away from the platform and preferably arcing at its extremities remote the platform and joined together to provide a support bottom); said support members defining a base at the support bottom remote the platform and being angled from a perpendicular from the platform corner (as best illustrated in FIG. 1), said angle DCA being defined by known trigonometric relationships [as found in the Engineering Handbook "Mathematics That Work" by Holbrook L. Norton of Industrial Press, N.Y.] wherein the sine of angle DCA is equivalent to the product of the sine of angle ABD and the cosine of angle BAC. Other equivalent formulae are expressed within the reference cited which will equally determine said angle DCA, said text of which is hereby incorporated by reference.

Further ratios exist dimensionally amongst the length, width and height and surface areas of the work unit at both its base and its platform wherein the overall sizing of the base is related to the height of the work unit, and the overall sizing of the platform is related to the height of the work unit.

According to another aspect of the invention, the support portions may be tubular and may include the bottom disposed with only side edges engaging the ground and central portion between side edges elevated and slightly bowed.

DETAILED DESCRIPTION OF THE DRAWINGS

Figure 1:
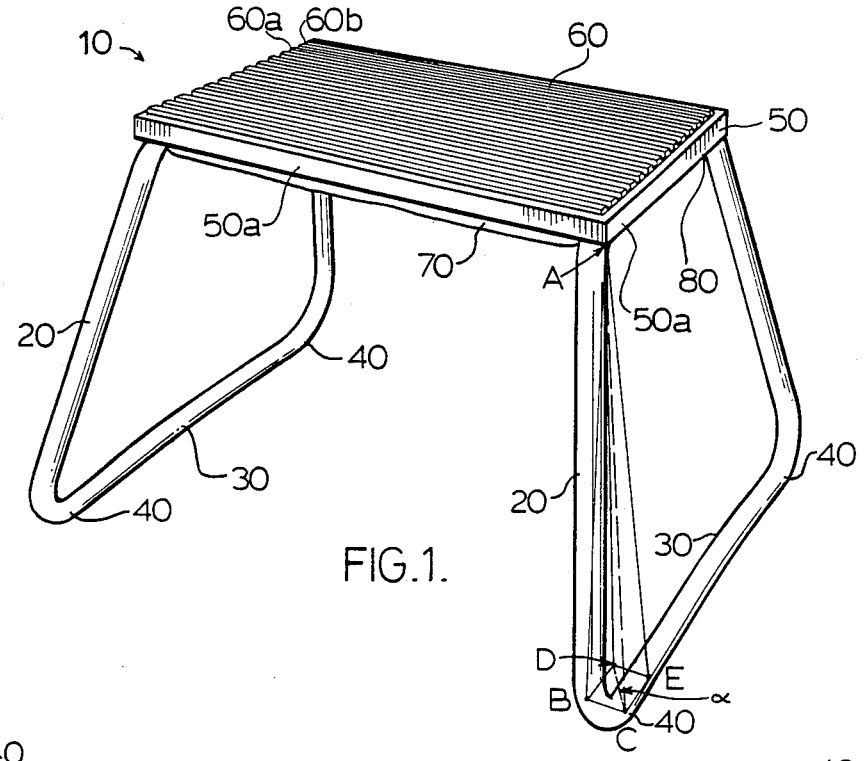
FIG. 1 is a perspective view of the work unit in a preferred embodiment of the invention.
Figure 6:
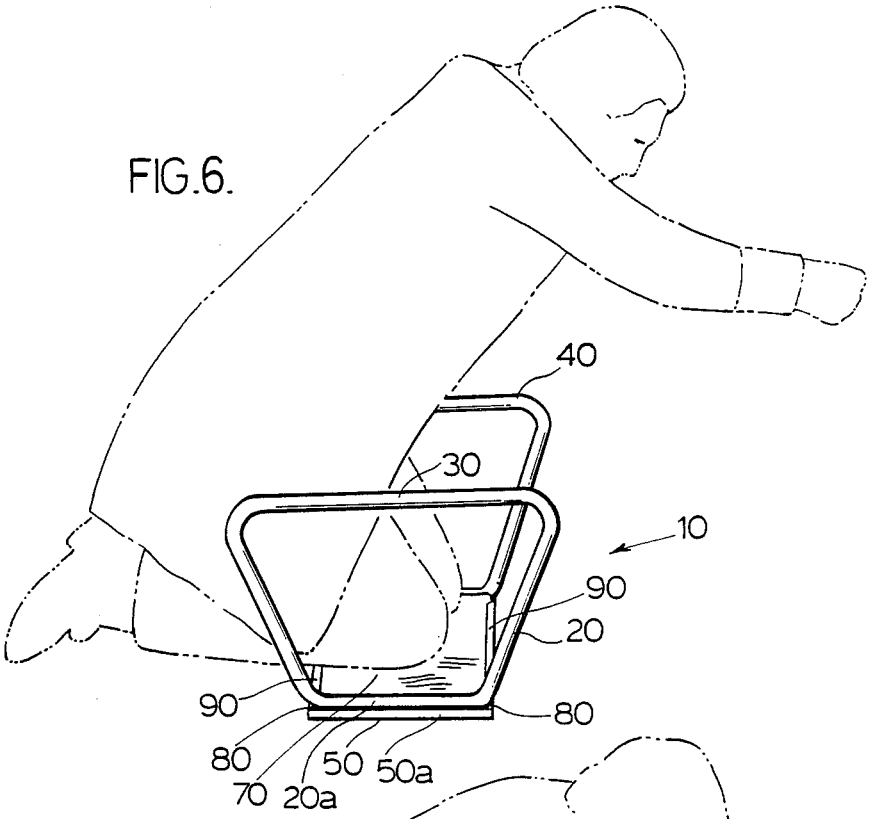
FIG. 6 is a perspective view of the work unit in use as a support device in supporting and cushioning an individual's shins and knees while accomplishing a task requiring the kneeling of the individual.
Figure 5:
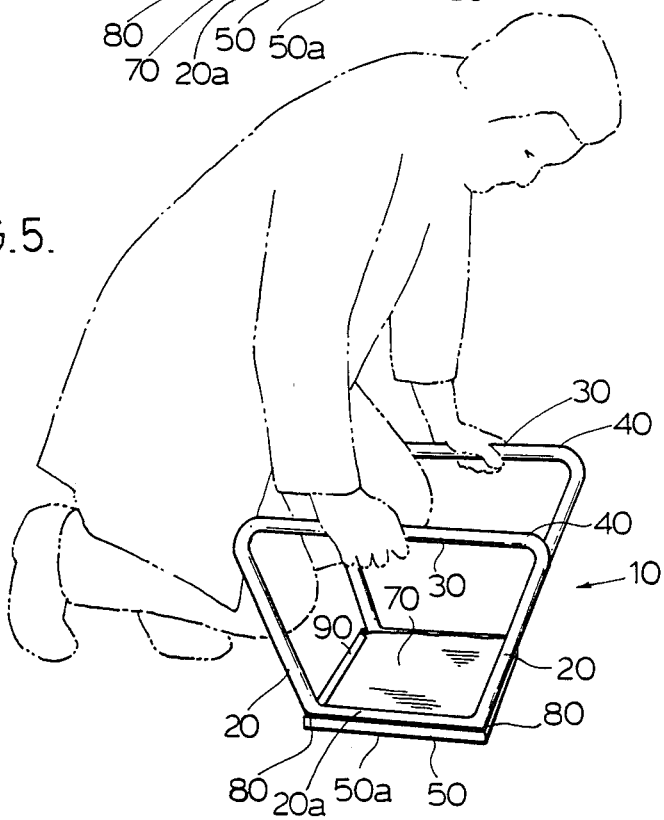
FIG. 5 is a perspective view of the work unit in use as a support device in assisting an individual from a standing to a kneeling position.

Referring now to the drawings depicting a preferred embodiment of the invention, in FIG. 1 work unit 10 is illustrated in perspective having rectangular platform 50 with a top surface, a downwardly extending rim 50(*a*), and having attached to said top surface an anti-slip surface 60 having disposed thereupon alternate grooves 60(*a*) and ridges 60(*b*) providing a positive traction means for footing. Supporting said platform 50 are tubular supports 20 affixed to said platform 50 at the four corners 80 and fastened to the underside of the top surface of platform 50 and the interior surface of rim 50(*a*). Said tubular support 20 extends downwardly away from platform 50 at an angle to the top plane of platform 50 such that tubular support 20 is formed from one continuous tubular member having arcuate bends at its extremities circumscribing said tubular support 20 having a top portion 20(*a*) as best seen in FIG. 5 or 6 affixed to the bottom of said platform 50, and bottom means 30, slightly bowed to create support heels 40 which are in direct contact with the surface upon which the work unit 10 rests.

Figure 2:
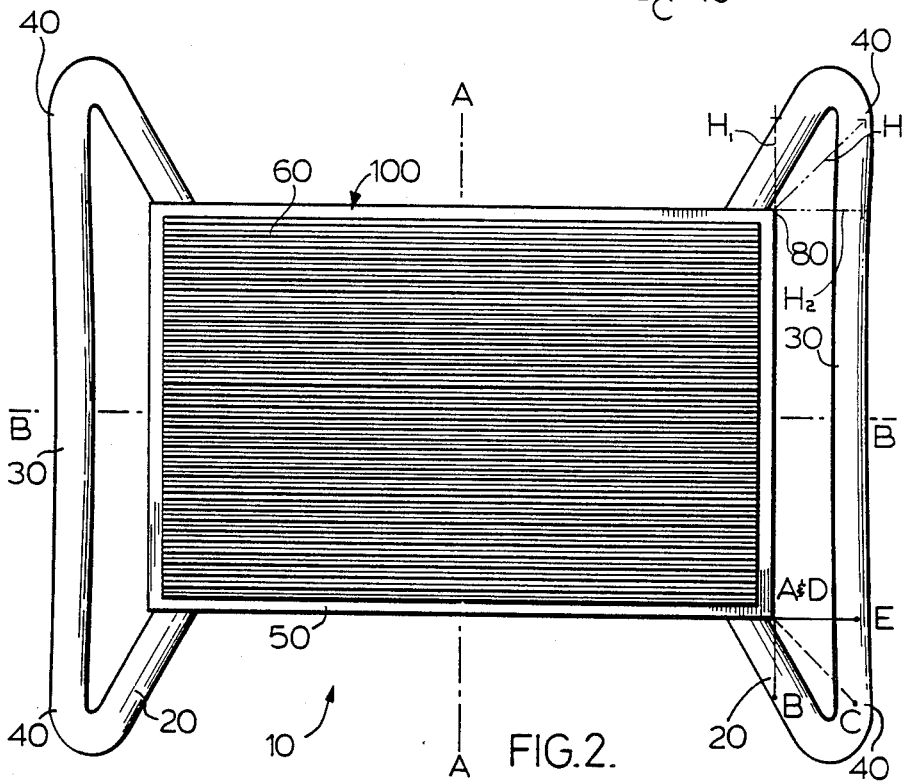
FIG. 2 is a top view of the work unit in a preferred embodiment of the invention.

Referring now to FIGS. 1 and 2, in order to better describe the angles at which the tubular supports extend from the platform of the work unit, a trigonometric relationship has been defined determining said angle referred to in FIG. 1 as angle $\alpha$ also defined as angle DCA wherein the sine $\alpha$=sine ABD X cos BAC (this relationship being extracted from "Mathematics That Work" by Holbrook L. Horton and Published by the Industrial Press of New York, hereby incorporated by reference). In each of the alternative embodiments of the work unit, distances AD, AE($H_2$), AB($H_1$), BD, ED, BC, and CE are known factors from which the definitions thereof thereby determine the other remaining dimensions by known mathematical methods.

Further ratios exist dimensionally amongst the length, width and height of the work unit at both its base (defined by the lines joining corners 40), and its platform (defined by the lines joining corners 80), wherein the overall sizing of the base of the work unit having length $L_{40}$ and width $W_{40}$ is related to the height of the work unit AD, and the overall sizing of the platform of the work unit having length $L_{80}$ and width $W_{80}$ is related to the height of the work unit AD, and the overall surface area of the base is related to the surface area of the platform. In a preferred embodiment of the work unit the following ratios exist:

$$\text{For the Base: } \frac{W_{40}}{AD} = \frac{1.55}{1} \quad \frac{L_{40}}{AD} = \frac{1.26}{1}$$

$$\text{For the Platform: } \frac{W_{80}}{AD} = \frac{.75}{1} \quad \frac{L_{80}}{AD} = \frac{1.15}{1}$$

$$\text{For the Area of the Base and Platform: } \frac{L_{80} \times W_{80}}{L_{40} \times W_{40}} = .4214$$

Referring now to FIG. 2, work unit 10 is illustrated in a top view depicting platform 50 supported by tubular support member 20 at support heels 40 having centre line A—A bisecting the length of platform 50 and centre line B—B bisecting the width of platform 50. It is apparent from FIG. 2 that support heels 40 are located a substantial horizontal (H) and vertical (V) distance away from platform corners 80 (as best illustrated in FIGS. 5 and 6); said horizontal distance H may be further resolved into component horizontal distances in parallel directions to centre lines A—A($H_1$) and B—B($H_2$) respectively. The further away support heels 40 are from platform corners 80 in horizontal directions $H_1$ and $H_2$, the more stable said work unit 10 will be from tipping or upset in direction A—A and B—B respectively. Of course the converse is true as well. Hence, by defining optional distances $H_1$ and $H_2$, the danger of tipping work unit 10 about either axis A—A or B—B is precluded.

Figure 3:
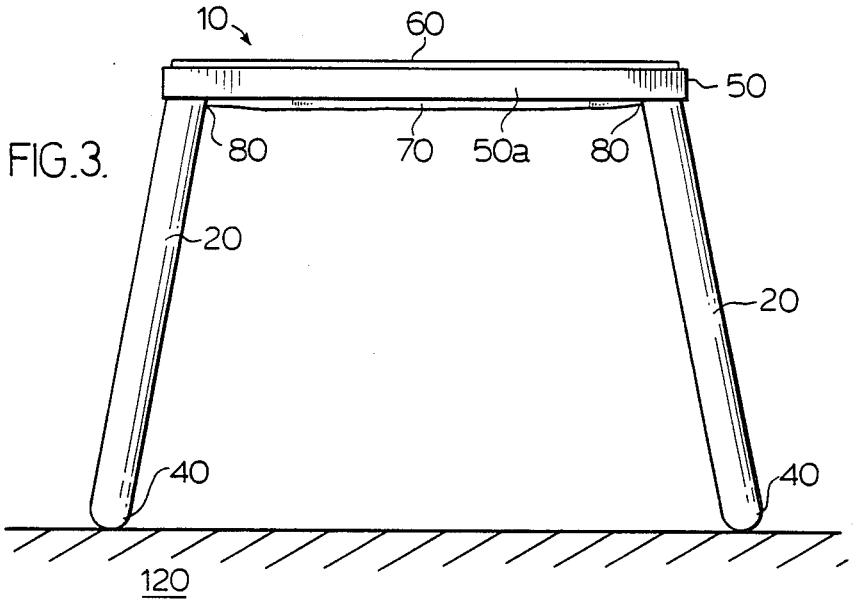
FIG. 3 is a front view of the work unit in a preferred embodiment of the invention.

Referring now to FIG. 3, work unit 10 is illustrated in a front view depicting support heels 40 of tubular support 20 in contact with floor 120. Further platform 50 having rim 50(*a*) attached to tubular support 20 at corners 80, is depicted illustrating the thickness of anti-slip surface 60 affixed to said platform 50 at its top surface, and oversized cushioning means 70 affixed to the bottom of said platform 50 by lip 90 of rim 50(*a*) (as best seen in FIGS. 5 or 6.)

Figure 4:
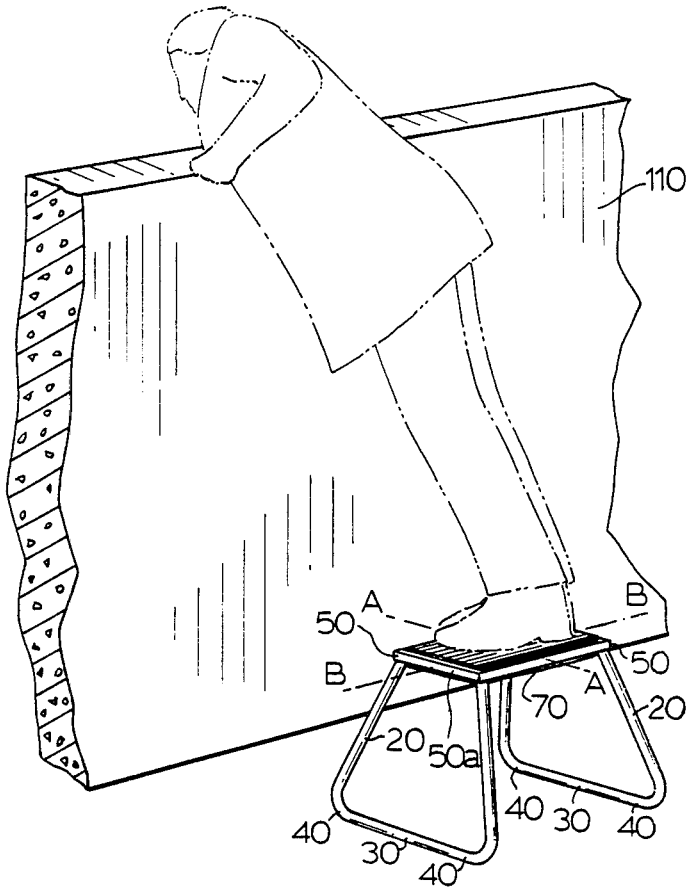
FIG. 4 is a perspective view of the work unit in use as a support device while accomplishing a reaching task over an obstruction.

Referring now to FIGS. 2 and 4, work unit 10 is illustrated in perspective in use as an anti-tipping work unit by an individual standing on work unit 50, firmly secured thereon by anti-slip surface 60. Said individual is reaching in direction A—A asserting a force at point 100 in a direction which could upset work unit 10 if support heel 40 of tubular member 20 were not disposed in a horizontal direction $H_1$ away from platform corner 80 (as best illustrated in FIG. 2) at a substantial distance to preclude work unit 10 from upsetting in direction A—A about centre line B—B. Alternatively, the illustrated individual might reach in direction B—B, asserting a force in that direction which could upset work unit 10 if support heel 40 of tubular member 20 were not disposed in a horizontal direction $H_2$ away from platform corner 80 (as best illustrated in FIG. 2) at a substantial distance to preclude work unit 10 from upsetting in direction B—B about centre line A—A. Hence work unit 10 is precluded from tipping in either direction A—A or B—B as a result of optional horizontal distances $H_1$ and $H_2$ of platform corners 80 from support heel 40 (as best illustrated in FIG. 2).

Referring now to FIG. 5, work unit 10 is illustrated in perspective in use as a support means for an individual having the anti-slip surface 60 atop platform 50 in positive contact with floor 120 (not shown), preventing said work unit 10 from slipping or sliding upon the floor because of traction grooves and ridges 60(*a*) and 60(*b*) disposed upon said anti-slip surface 60. In FIG. 5, the individual is in the process of assuming a kneeling position (upon cushioning means 70 of work unit 10) from a standing position whereby said individual utilizes tubular support members 20 for support by clamping each hand about bottom means 30 of tubular support members 20 and lowering himself/herself while supported until his/her knees and shins are securely resting and cushioned upon cushion means 70 of work unit 10 (as illustrated in FIG. 6). The oversized cushion means 70 is retained within a hollow cavity of platform 50 defined by the underside of platform 50, the interior surfaces of peripheral rims 50(*a*), inward-facing lips 90 affixed to peripheral rim 50(*a*) on two sides in the illustrated embodiment, and abutting interior surfaces of the tops 20(*a*) of tubular support members 20. It is apparent from FIG. 5 that the fastening means of tubular support member 20 at support tops 20(*a*) to platform 50 must be substantial enough to accept the heaviest individual possible without weakening the joint between said support member 20 and the platform 50. Further, tubular support member 20 must be of substantial strength throughout its length to positively support any individual utilizing said work unit 10 as a support means. To enhance the supporting ability of tubular support member 20, horizontal support tops and bottoms 20(*a*) and 30 are provided, said top and bottom means 20(*a*) and 30 providing support to a user as well as rigidifying the tubular support member 20 throughout whether said work unit 10 is used as a support means device or a stepping stool device.

Referring now to FIG. 6, work unit 10 is illustrated in perspective in use as a kneeling device for an individual in exactly the same relationship as within FIG. 5 with the exception that the individual has assumed a kneeling position having his/her knees and shins resting on cushioning means 70 included within platform 50 and in the illustrated embodiment the individual is working at a task requiring his/her kneeling for prolonged periods comfortably secured upon his/her knees by cushioning means 70 of work unit 10 which is securely abutting the floor surface 120 (as illustrated in FIG. 3) by anti-slip surface 60 upon platform 50. Upon completion of the work required, the individual can assume a standing position by utilizing bottom means 30 of tubular support 20 to support his/her weight and assist in the assumption of a standing position.

As many changes can be made to the preferred embodiments without departing from the scope of the invention; it is intended that all matter contained herein be interpreted as illustrative of the invention and not in a limiting sense.

The embodiments of the invention in which an exclusive property or privilege is claimed are as follows:

1. A multi-purpose work unit comprising a platform having; a top side, and bottom side, carrying on the platform top an anti-slip surface, and a padding on the bottom side; a plurality of support members of alternative cross-section having a top section extending from the bottom side of the platform at its extremities parallel to the platform top and abutting the interior surfaces of the platform and fastened thereto, said support members continuing from the platform extremities in a downward angle away from the platform and arcing at the extremities of the support remote the platform defining a support member bottom, continuing therefrom in complimentary circumscription returning to its origin at the underside of the platform; wherein ratios exist dimensionally amongst the length, width and height and surface areas of the work unit at both its base and its platform wherein the overall sizing of the base is related to the height of the work unit and the overall sizing of the platform is related to the height of the work unit.

2. A multi-purpose work unit comprising a platform having; a top side, and bottom side, carrying on the platform top an anti-slip surface, and a padding on the bottom side; a plurality of support members of alternative cross-section having a top section extending from the bottom side of the platform at its extremities parallel to the platform top and abutting the interior surfaces of the platform and fastened thereto, said support members continuing from the platform extremities in a downward angle away from the platform and arcing at the extremities of the support remote the platform defining a support member bottom, continuing therefrom in complimentary circumscription returning to its origin at the underside of the platform, wherein ratios exist dimensionally amongst the length, width, height and surface areas of the work unit at both its base and its platform wherein the overall sizing of the base is related to the height of the work unit, and the overall sizing of the platform is related to the height of the work unit; wherein the overall sizing of the base of the work unit having length L40 and width W40 is related to the height of the work unit AD, and the overall sizing of the platform of the work unit having length L80 and width W80 is related to the height of the work unit AD, and the overall surface areas of base L40×W40 is related to the overall area of the platform L80×W80 as defined by the following relationships:

$$\text{(a) For the Base: } \frac{W_{40}}{AD} = \frac{1.55}{1} \quad \frac{L_{40}}{AD} = 1.26$$

$$\text{(b) For the Platform: } \frac{W_{80}}{AD} = \frac{.75}{1} \quad \frac{L_{80}}{AD} = \frac{1.15}{1}$$

$$\text{(c) For the Area of the Base and Platform: } \frac{L_{80} \times W_{80}}{L_{40} \times W_{40}} = .4214$$

3. The work unit of claim 1, wherein the padding comprises a pliable oversized compatibly-shaped cushioning means inserted within a cavity defined on the bottom side of the platform, said padding extending within the cavity abutting all inward interior surfaces contained therein and extending below the bottom of the platform; the cushioning means being supported in the cavity by a peripheral rim extending downwardly from the platform and a lip extending inwardly from the bottom of the peripheral rim.

4. The work unit of claim 2, wherein the padding comprises a pliable oversized compatibly-shaped cushioning means inserted within a cavity defined on the bottom side of the platform, said padding extending within the cavity abutting all inward interior surfaces contained therein and extending below the bottom of the platform; the cushioning means being supported in the cavity by a peripheral rim extending downwardly from the platform and a lip extending inwardly from the bottom of the peripheral rim.

5. The work unit of claim 1, wherein the support members comprise a top portion for engaging and being secured to the platform bottom, the support members carrying downwardly angled and outwardly angled side portions extending angularly away from the platform in a multiplicity of directions (preferably at an angle of $\alpha$ degrees to the side portions) preferably being connected at their ends remote the top portion by a bottom portion, the ends of which are secured to the side portions for engaging the ground and the central section of the bottom portion being elevated or bowed being spaced from the ground when the ends thereof engage the ground or floor thereby creating a multiplicity of heels or contact points to the ground or floor; wherein angle $\alpha$ is defined as angle DCA further defined by a trigonometric relationship wherein the angle may be determined by the following formula: $\sin \alpha = (-\sin ABD) \times (\cos BAC)$.

6. The work unit of claim 2, wherein the support members comprise a top portion for engaging and being secured to the platform bottom, the support members carrying downwardly angled and outwardly angled side portions extending angularly away from the platform in a multiplicity of directions (preferably at an angle of $\alpha$ degrees to the side portions) preferably being connected at their ends remote the top portion by a bottom portion, the ends of which are secured to the side portions for engaging the ground and the central section of the bottom portion being elevated or bowed being spaced from the ground when the ends thereof engage the ground or floor thereby creating a multiplicity of heels or contact points to the ground or floor; wherein angle $\alpha$ is defined as angle DCA further defined by a trigonometric relationship wherein the angle may be determined by the following formula: $\sin \alpha = (-\sin ABD) \times (\cos BAC)$.

7. The work unit of claim 3, wherein the support members comprise a top portion for engaging and being secured to the platform bottom, the support members carrying downwardly angled and outwardly angled side portions extending angularly away from the platform in a multiplicity of directions (preferably at an angle of $\alpha$ degrees to the side portions) preferably being connected at their ends remote the top portion by a bottom portion, the ends of which are secured to the side portions for engaging the ground and the central section of the bottom portion being elevated or bowed being spaced from the ground when the ends thereof engage the ground or floor thereby creating a multiplicity of heels or contact points to the ground or floor; wherein angle $\alpha$ is defined as angle DCA further defined by a trigonometric relationship wherein the angle may be determined by the following formula: $\sin \alpha = (-\sin ABD) \times (\cos BAC)$.

8. The work unit of claim 1, wherein the support members are each formed from one continuous member.

9. The work unit of claim 2, wherein the support members are each formed from one continuous member.

10. The work unit of claim 3, wherein the support members are each formed from one continuous member.

11. The work unit of claim 4, wherein the support members are each formed from one continuous member.

12. The work unit of claim 5, wherein the support members are each formed from one continuous member.

13. The work unit of claim 6, wherein the support members are each formed from one continuous member.

14. The work unit of claim 7, wherein the support members are each formed from one continuous member.

15. The work unit of claim 5 wherein the heels of the support members are offset optional horizontal distances $H_1$ and $H_2$ from the platform corners (as best illustrated in FIG. 2) thereby precluding tipping.

16. The work unit of claim 1 wherein the anti-slip surface has incorporated therein a plurality of grooves and ridges.

17. The work unit of claim 6 wherein the heels of the support members are offset optional horizontal distances $H_1$ and $H_2$ from the platform corners (as best illustrated in FIG. 2) thereby precluding tipping.

18. The work unit of claim 7 wherein the heels of the support members are offset optional horizontal distances $H_1$ and $H_2$ from the platform corners (as best illustrated in FIG. 2) thereby precluding tipping.

19. The work unit of claim 2 wherein the anti-slip surface has incorporated therein a plurality of grooves and ridges.

20. The work unit of claim 5 wherein the anti-slip surface has incorporated therein a plurality of grooves and ridges.

21. The work unit of claim 6 wherein the anti-slip surface has incorporated therein a plurality of grooves and ridges.

22. The work unit of claim 7 wherein the anti-slip surface has incorporated therein a plurality of grooves and ridges.

* * * * *